US007458491B2

(12) United States Patent
Cragg

(10) Patent No.: US 7,458,491 B2
(45) Date of Patent: Dec. 2, 2008

(54) CONCEALED MAGAZINE SLOT ARRANGEMENT FOR CHEST HARNESS, MIDRIFF HARNESS, VEST, OR THE LIKE

(76) Inventor: James Victor Cragg, 8515 Washington Blvd., Culver City, CA (US) 90232

( * ) Notice: Subject to any disclaimer, the term of this patent is extended or adjusted under 35 U.S.C. 154(b) by 345 days.

(21) Appl. No.: 10/694,233

(22) Filed: Oct. 27, 2003

(65) Prior Publication Data

US 2004/0245304 A1 Dec. 9, 2004

Related U.S. Application Data

(60) Provisional application No. 60/508,417, filed on Oct. 3, 2003.

(51) Int. Cl.
*A45F 3/04* (2006.01)

(52) U.S. Cl. ..... 224/648; 224/655; 224/931; 224/651; 224/653; 224/654

(58) Field of Classification Search ..... 224/615–655, 224/659, 931; 2/102, 247, 253
See application file for complete search history.

(56) References Cited

U.S. PATENT DOCUMENTS 1,290,827 A * 1/1919 Yergason ..... 224/623
1,340,077 A * 5/1920 Orr ..... 224/640
1,340,142 A * 5/1920 Batchelder ..... 224/682
3,968,522 A * 7/1976 Riess ..... 2/250
5,505,356 A * 4/1996 Noriega et al. ..... 224/250
5,517,696 A * 5/1996 Krugler ..... 2/250
5,829,060 A 11/1998 Falk et al.
6,131,198 A 10/2000 Westrick
6,135,333 A * 10/2000 Tucker et al. ..... 224/646
6,402,002 B1 * 6/2002 Benton ..... 224/600
6,561,402 B2 * 5/2003 Holland et al. ..... 224/677
6,662,373 B2 12/2003 Frank
2002/0014507 A1 * 2/2002 Snider et al. ..... 224/671
2002/0145027 A1 * 10/2002 Godshaw et al. ..... 224/605

* cited by examiner

*Primary Examiner*—Tri M Mai
(74) *Attorney, Agent, or Firm*—Cislo & Thomas, LLP

(57) ABSTRACT

A concealed magazine slot arrangement includes a magazine holder, a gear carrier, and a fastening device for fastening the magazine holder on the user's body. The magazine holder includes an inner panel, an outer panel, having a front operation side, overlapped thereon, and a plurality of slot dividers affixed between the inner and outer panels to form a plurality of magazine slots concealed within the inner panel, the outer panel, and the slot dividers for receiving the magazine. A gear carrier is provided on the front operation side of the magazine holder for carrying a gear thereon. Accordingly, the magazine holder is warped for fitting a curvature of the user's body, such that the outer panel is reinforced to substantially bias against the inner panel to physically self-adjust a shape of the magazine slots for retaining the magazine within the respective magazine slot of the magazine holder.

8 Claims, 6 Drawing Sheets

CONCEALED MAGAZINE SLOT ARRANGEMENT FOR CHEST HARNESS, MIDRIFF HARNESS, VEST, OR THE LIKE

CROSS REFERENCE OF RELATED APPLICATION

This is a Regular Application of a provisional application, application No. 60/508,417, filed Oct. 3, 2003.

BACKGROUND OF THE PRESENT INVENTION

1. Field of Invention

The present invention relates to a military gear, and more particularly to a concealed magazine slot arrangement for chest harness, midriff harness, vest, or the like, wherein the concealed magazine slot arrangement comprises a magazine holder having a plurality of magazine slots alignedly formed in a concealed manner such that the magazine holder provides a front operation side for holding other gears thereon.

2. Description of Related Arts

Loaded magazines are often utilized during combat situations, various magazine carriers are develop to carry the loaded magazines on the user's body such that the user is able to conveniently transport and store the loaded magazines as the spare magazines during combat situation. Accordingly, the magazine carrier not only securely and safety accommodates the loaded magazine especially during the movement of the user but also provide a quick release and access of the load magazine. Therefore, most magazine carriers are incorporated with a vest or other garment worn by the user such that the user is able to reach the magazine carrier for easy accessing the loaded magazines.

A typical magazine carrier comprises a fastening pad adapted for wearing on the user body, and a plurality of magazine pouches formed on the front side of the fastening pad for holding the loaded magazines respectively. Therefore, when the user wears the magazine carrier, the user is able to easily reach the magazine pouches and quickly access the loaded magazines therein. However, such magazine carrier has several drawbacks.

The magazine carrier is mainly designed only for carrying the magazines such that other gears must utility other carrying devices. However, the front side of the fastening pad is occupied by the magazine pouches, the carrying devices must be carried at other locations on the user's body. It is worth to mention that when lots of carrying devices are held on the user's body, the mobility of the user will substantially reduced. Therefore, no alternative usage of the conventional magazine carrier can be provided.

In addition, the magazine carrier can only carry a predetermined numbers of magazines therein such that when all the magazines are used up, the magazine carrier becomes an extra burden gear on the user's body. In other words, when the user needs to carry more magazines, an additional magazine carrier must be carried on the user's body.

Furthermore, the magazine must be securely held within the magazine pouch especially during the movement of the user while the magazine must be quickly released from the magazine pouch for use. Failure to quickly access the magazine during the combat situation may cause injury or death. However, it is a conflict between the quick access and the secure retention of the magazine in the magazine pouch.

SUMMARY OF THE PRESENT INVENTION

A main object of the present invention is to provide a concealed magazine slot arrangement for chest harness, midriff harness, vest, or the like, wherein the concealed magazine slot arrangement comprises a magazine holder having a plurality of magazine slots alignedly formed in a concealed manner such that the magazine holder provides a front operation side for holding other gears thereon.

Another object of the present invention is to provide a concealed magazine slot arrangement which can be quickly and easily carried at the chest or midriff of the user. In addition, the concealed magazine slot arrangement can be constructed as a vest that the user is able to wear the concealed magazine slot arrangement for carrying the magazines.

Another object of the present invention is to provide a concealed magazine slot arrangement, wherein the magazine holder comprises an inner panel and an outer panel overlapped thereon to form the magazine slots between the inner and outer panels in a concealed manner, such that the front operation side of the outer panel can be utilized for holding other gears thereon.

Another object of the present invention is to provide a concealed magazine slot arrangement, wherein when the user wears the magazine holder, the inner and outer panels are bent to fit the curvature of the user's body, such that the magazines held within the magazine slots are securely retained by the physical curvature of the user's body.

Another object of the present invention is to provide a concealed magazine slot arrangement which further comprises a quick accessing fastener to not only provide a secure retention of the magazine within the respective magazine slot but also provide a rapid and easy access of the magazine withdrawing from the magazine slot.

Another object of the present invention is to provide a concealed magazine slot arrangement, wherein an additional magazine carrier can be detachably fastened with the concealed magazine slot arrangement so as to substantially increase the numbers of magazine carried by the user without reducing the mobility of the user.

Accordingly, in order to accomplish the above objects, the present invention provides a concealed magazine slot arrangement for carrying at least a magazine on a user's body, comprising:

a magazine holder comprising an inner panel, an outer panel, having a front operation side, overlapped on the inner panel, and a plurality of slot dividers transversely and spacedly affixed between the inner and outer panels to form a plurality of magazine slots concealed within the inner panel, the outer panel, and the slot dividers for receiving the magazine;

a gear carrier provided on the front operation side of the magazine holder for carrying a gear thereon; and means for detachably fastening the magazine holder on the user's body, wherein the magazine holder is warped for fitting a curvature of the user's body, such that the outer panel is reinforced to substantially bias against the inner panel to physically self-adjust a shape of the magazine slots for retaining the magazine within the respective magazine slot of the magazine holder.

These and other objectives, features, and advantages of the present invention will become apparent from the following detailed description, the accompanying drawings, and the appended claims.

DETAILED DESCRIPTION OF THE PREFERRED EMBODIMENT

Figure 1:
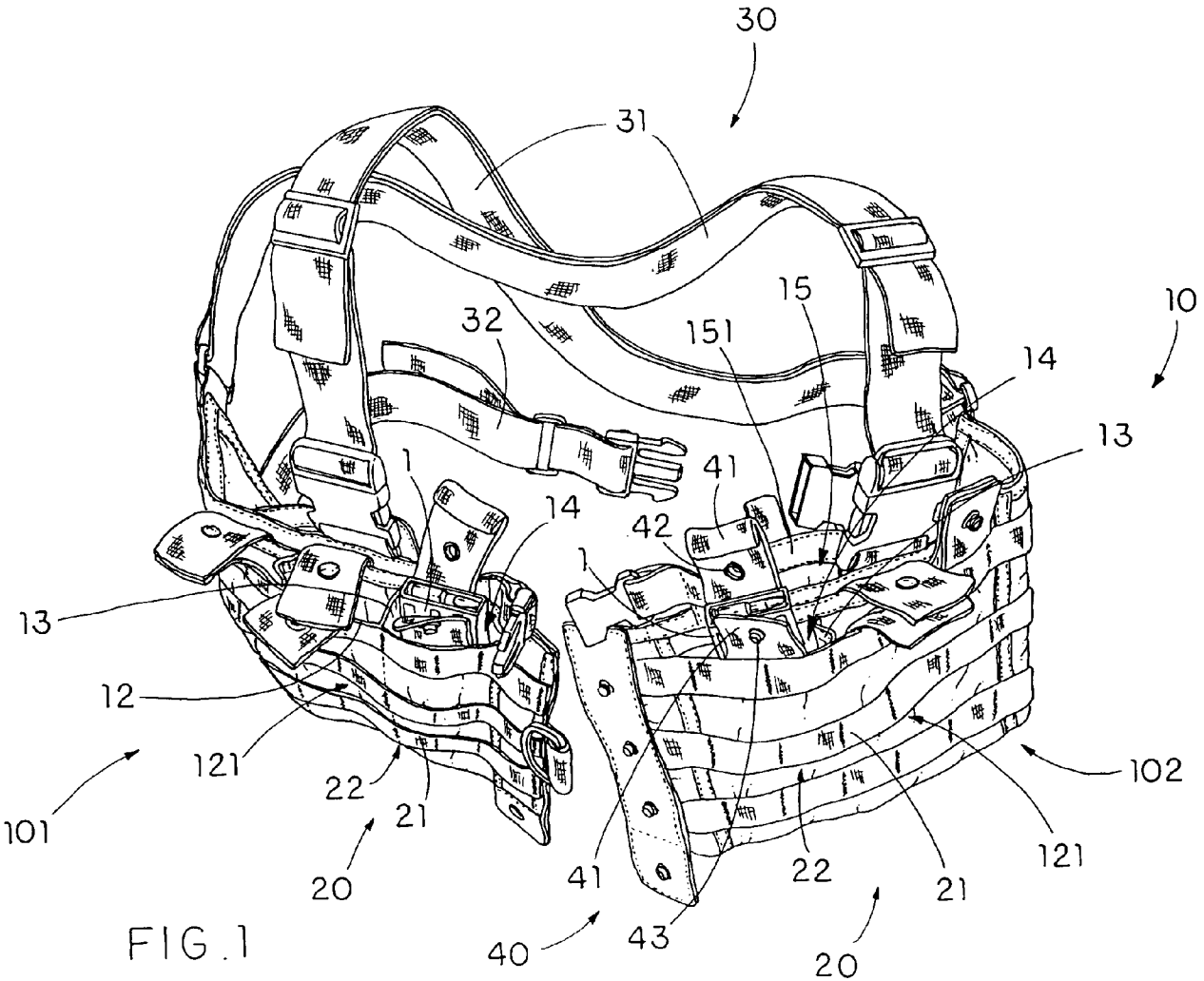
FIG. 1 is a perspective view of a concealed magazine slot arrangement according to a preferred embodiment of the present invention.
Figure 2:
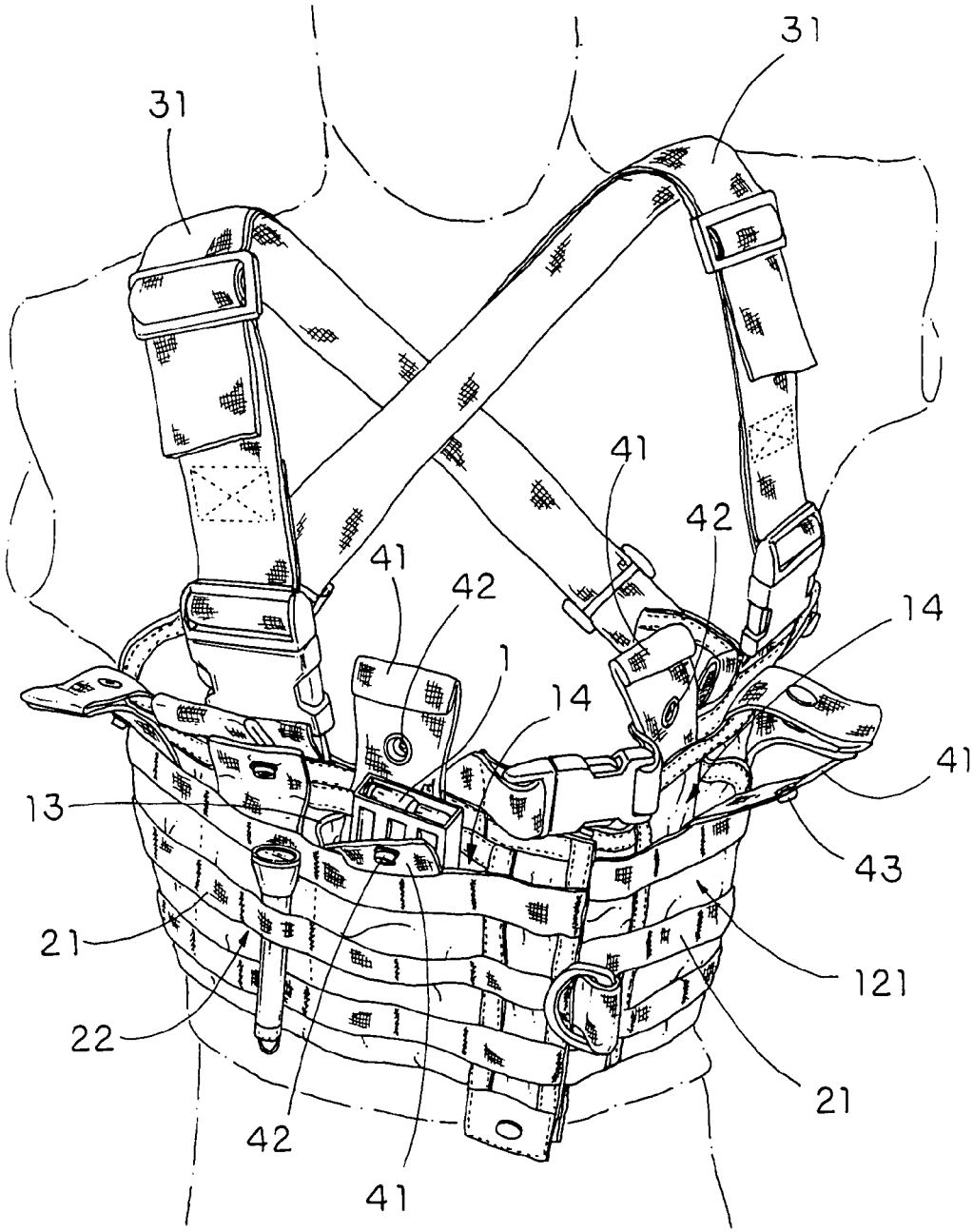
FIG. 2 is a perspective view of the concealed magazine slot arrangement as a vest worn on the user according to the above preferred embodiment of the present invention.

Referring to FIGS. 1 and 2 of the drawings, a concealed magazine slot arrangement according to a preferred embodiment of the present invention is illustrated, wherein the concealed magazine slot arrangement is adapted for carrying at least a magazine 1 on a user's body.

The concealed magazine slot arrangement comprises a magazine holder 10 comprising an inner panel 11, an outer panel 12, having a front operation side 121, overlapped on the inner panel 11, and a plurality of slot dividers 13 transversely and spacedly affixed between the inner and outer panels 11, 12 to form a plurality of magazine slots 14 concealed within the inner panel 11, the outer panel 12, and the slot dividers 13 for receiving the magazine 1.

The concealed magazine slot arrangement further comprises a gear carrier 20 provided on the front operation side 121 of the magazine holder 10 for carrying a gear thereon, and means 30 for detachably fastening the magazine holder 10 on the user's body, wherein the magazine holder 10 is warped for fitting a curvature of the user's body, such that the outer panel 12 is reinforced to substantially bias against the inner panel 11 to physically self-adjust a shape of the magazine slots 14 for retaining the magazine 1 within the respective magazine slot 14 of the magazine holder 10.

According to the preferred embodiment, the magazine holder 10 is made of durable fabric such as nylon such that the magazine holder 10 is adapted to be wrapped to fit the curvature of the user's body. The outer panel 12 is overlappedly attached to the inner panel 11 to form an opening of each of the magazine slots 14. Each of the slot dividers 13 has two transverse edges securely affixed to an outer side of the inner panel 11 and an inner side of the outer panel 12 respectively to form the magazine slot 14 within each two slot dividers 13, the inner panel 11, and the outer panel 12. It is worth to mention that the magazine slots 14 are concealed between the inner and outer panel 12 such that the magazine 1 can be concealed in the magazine holder 10.

Due to the physical structure of the magazine holder 10, the magazine holder 10 allows to provide the front operation side 121 to be utilized. As shown in FIG. 1, the gear carrier 20 is provided on the front operation side 121 of the magazine holder 10 for carrying a gear thereon. The gear carrier 20 comprises a plurality of webbing straps 21 longitudinally formed on the front operation side 121 of the magazine holder 10 wherein each of the webbing straps 21 is spacedly sewn on the front operation side 121 of the magazine holder 10 to form a plurality of gear slots 22 for slidably receiving the gear therethrough. Accordingly, the gear such as flash light can be slid through the gear slot 22 so as to hold the gear on the front operation side 121 of the magazine holder 10. It is worth to mention that an additional magazine holder can be held on the front operation side 121 of the magazine holder 10 via the gear carrier 20 so as to substantially increase the numbers of magazine 1 on the user's body.

The fastening means 30 comprises a shoulder strap 31 upwardly extended from the magazine holder 10 and a waist strap 31 sidewardly extended from the magazine holder 10 such that the magazine holder 10 serves as a vest for being worn on the user's body while the magazine slots 14 are positioned at the chest of the user. It is worth to mention that when the user wears the magazine holder 10 via the fastening means 30, the inner and outer panels 11, 12 of the magazine holder 10 are self-adjustably wrapped to fit the curvature of the user's body such that the outer panel 12 is physically bent to apply holding force against the magazines 1 within the magazine slots 14 respectively so as to reinforce the magazine 1 in the respective magazine slot 14 in position.

In comparison with the conventional magazine carrier, the magazine pockets are formed on the front side of the magazine carrier such that when the magazine is received in the magazine pocket, an unwanted movement of the magazine is created within the magazine pocket during the movement of the user. It is a burden for the user that the magazines trembled in the magazine pockets especially during combat situation. However, the concealed magazine slot arrangement of the present invention minimizes the magazines 1 trembled in the magazine slots 14 during the movement of the user. In addition, the magazines 1 are tightly positioned close to the user's body so as to enhance the mobility of the user while carrying the magazines 1.

As shown in FIG. 1, since the magazine holder 10 serves as a vest for being worn on the user's body, the magazine holder 10 is constructed to have two side portions 101, 102 detachably affixing with each other edge to edge to form a front opening 103 between the two side portions 101, 102, wherein the magazine slots 14 are respectively formed at the side portions 101, 102 of the magazine holder 10. Therefore, the user is able to easily wear the concealed magazine slot arrangement of the present invention as an ordinary vest.

Figure 3C:
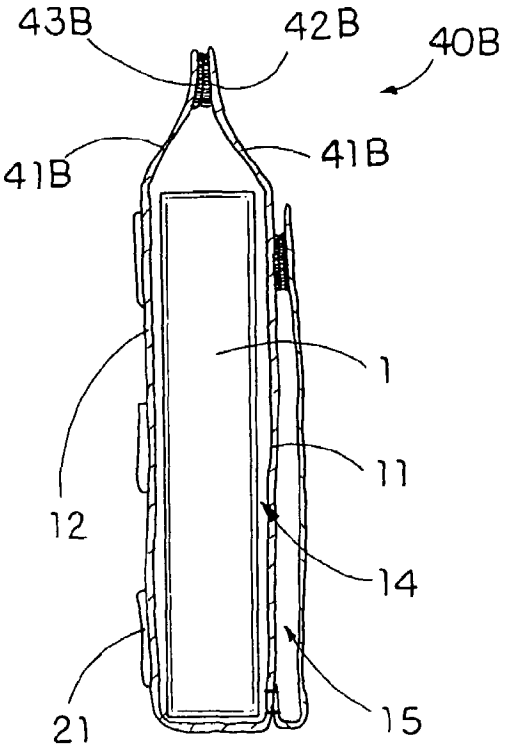
FIGS. 3A through 3H are sectional views of the concealed magazine slot arrangement and the alternative modes of the quick accessing fastener of the concealed magazine slot arrangement according to the above preferred embodiment of the present invention.

The concealed magazine slot arrangement further comprises a quick accessing fastener 40 for securely retaining the magazine 1 within the respective magazine slot 14 and for providing a quick access of the magazine 1 to withdraw from the respective magazine slot 14. As shown in FIGS. 1 and 3A, the quick accessing fastener 40 comprises two elongated straps 41 extended from the inner panel 11 and the outer panel 12 respectively at an opening of each of the magazine slots 14, and first and second fasteners 42, 43 respectively formed at the two elongated straps 41 wherein the first fasteners 42 is detachably fastened with the second fastener 43 to enclose the respective magazine slot 14 for securely holding the magazine 1 therein. Therefore, the user is able to simply detach the first fastener 42 from the second fastener 43 such that the user can rapidly and easily access the magazine 1 in the magazine slot 14 while the magazine 1 is still retain by the curvature of the user's body. Accordingly, the first and second fasteners 42, 43 are preferably hook and loop fasteners.

Figure 3B:
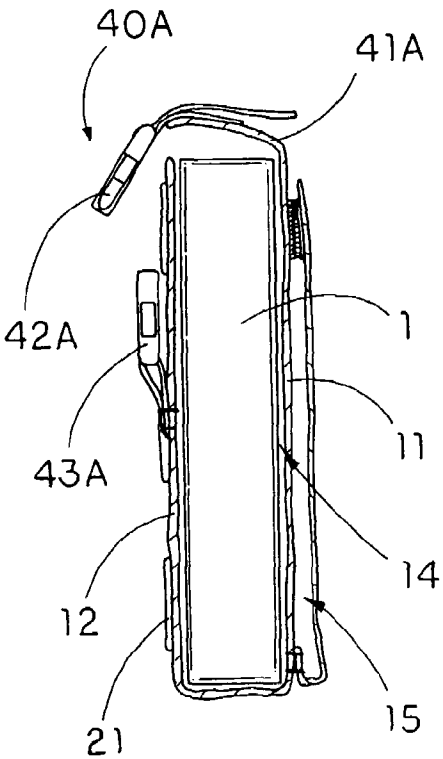
Figure 3A:
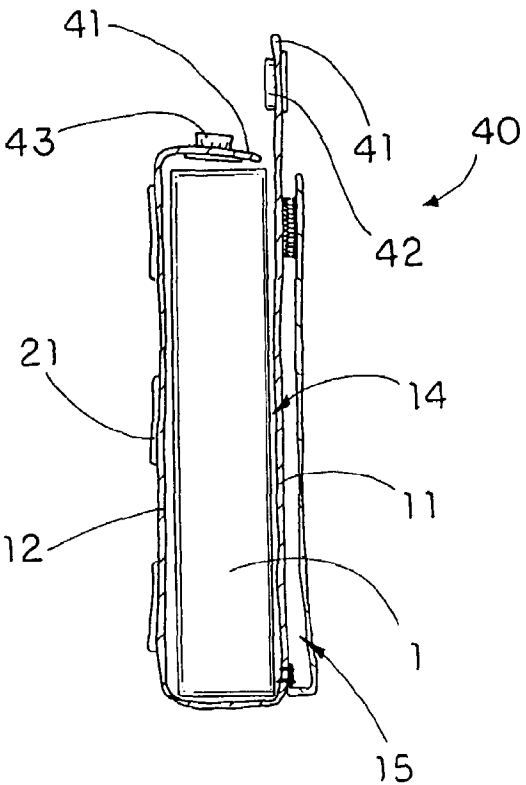

Alternatively, the quick accessing fastener 40A comprises a shielding strap 41A extended from the inner panel 11 of the magazine holder 10 and first and second fasteners 42A, 43A respectively formed on the shielding strap 41A and the front operation side 11 of the outer panel 12, as shown in FIG. 3B, wherein the first fasteners 42A is detachably fastened with the second fastener 43A to enclose the respective magazine slot 14 by the shielding strap 41A for securely holding the magazine 1 therein. Accordingly, the first and second fasteners 42A, 43A are preferably a buckle plug and a buckle socket respectively.

It is worth to mention that the first and second fasteners 42A, 43A can be a pair of snap fasteners, as shown in FIG. 1, wherein an additional second fastener can be provided on the front operation side 11 of the outer panel 12 such that the first fasteners 42A can be selectively fastened with either the second fastener 43A or the addition second fastener to adjust a height of the magazine slot 14 for fitting the magazines 1 having various sizes.

FIG. 3C illustrates another alternative mode of the quick accessing fastener 40B which comprises two elongated straps 41B extended from the inner panel 11 and the outer panel 12 respectively at an opening of each of the magazine slots 14, and first and second fasteners 42B, 43B respectively formed at the two elongated straps 41 wherein the first fasteners 42B is detachably fastened with the second fastener 43B to enclose the respective magazine slot 14 for securely holding the magazine 1 therein. Accordingly, the first and second fasteners 42B, 43B are hook and loop fasteners.

Figure 3D:
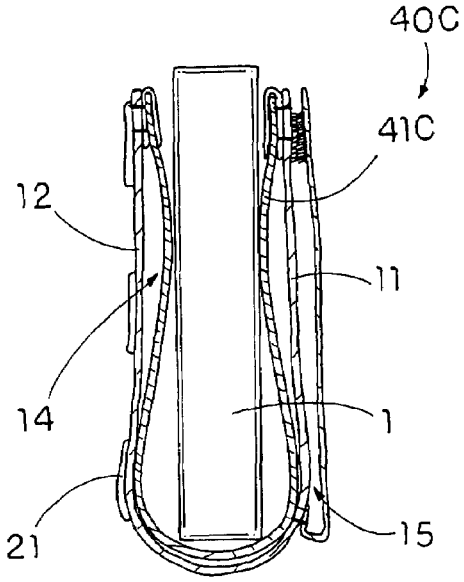

FIG. 3D illustrates another alternative mode of the quick accessing fastener 40C which comprises an elastic tension clip 41C securely disposed in each of the magazine slots 14 for applying an elastic clipping force on the magazine 1 when the magazine 1 is received in the respective magazine slot 14. However, the user is able to rapidly slide out the magazine 1 from the magazine slot 14 by pulling out the magazine 1 from the tension clip 41C.

Figure 3E:
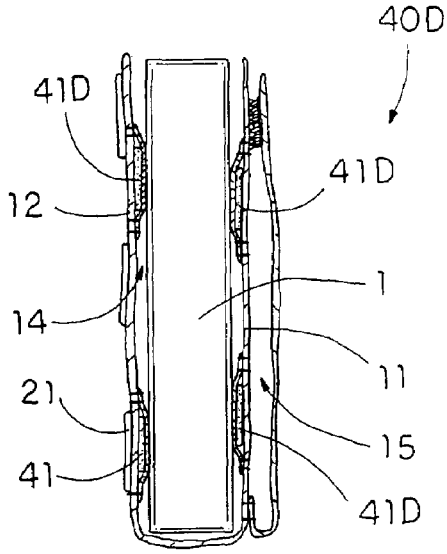

Another alternative mode of the quick accessing fastener 40D is shown in FIG. 3E, wherein the quick accessing fastener 40D comprises at least two magnetic members 41D respectively formed on the inner and outer panels 11, 12 of the magazine holder 10 within each of the magazine slots 14 for magnetically attaching the magazine 1 so as to hold the magazine 1 within the magazine slot 14. It is worth to mention that since the magazine 1 is usually made of material having magnetic attraction ability such that when the magazine 1 is received in the respective magazine slot 14, the magnetic members 41D magnetically attached with the magazine 1 to hold the magazine 1 in position while the user is able to rapidly withdraw the magazine 1 from the magazine slot 14. Accordingly, the two magnetic members 41D are two magnets respectively embedded on the inner and outer panels 11, 12 of the magazine holder 10 within each of the magazine slots 14.

Figure 3F:
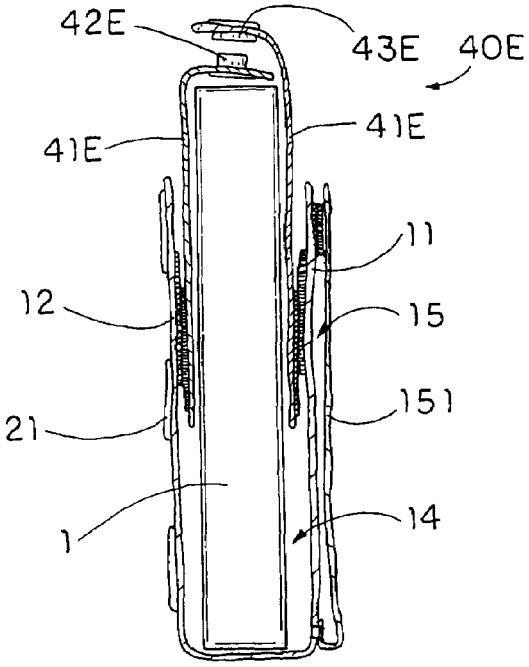

FIG. 3F illustrates another alternative mode of the quick accessing fastener 40E which comprises two pouch flaps 41E detachably and adjustably attached to the inner and outer panels 11, 12 respectively within the magazine slot 14 and first and second fasteners 42E, 43E respectively formed at the two pouch straps 41E wherein the first fasteners 42E is detachably fastened with the second fastener 43E to enclose the respective magazine slot 14 for securely holding the magazine 1 therein.

As shown in FIG. 3F, two lower portions of the pouch flaps 41E are detachably attached to the inner and outer panels 11, 12 via two pairs of hook and loop fasteners respectively, wherein the first and second fasteners 42E, 43E are provided at two upper portions of the pouch flaps 41E in such a manner that the pouch flaps 41E are adapted to selectively attached to the inner and outer panels 11, 12 to adjust a height of the respective magazine slot 14 for fitting the magazine 1 therewithin. Accordingly, the first and second fasteners 42E, 43E are also a pair of hook and loop fasteners.

Figure 3G:
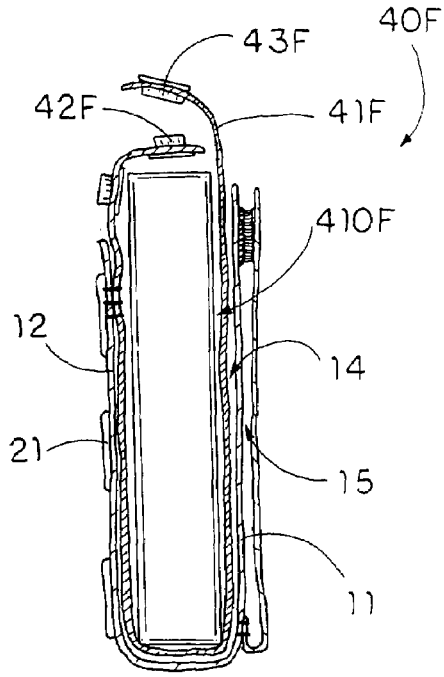
Figure 3H:
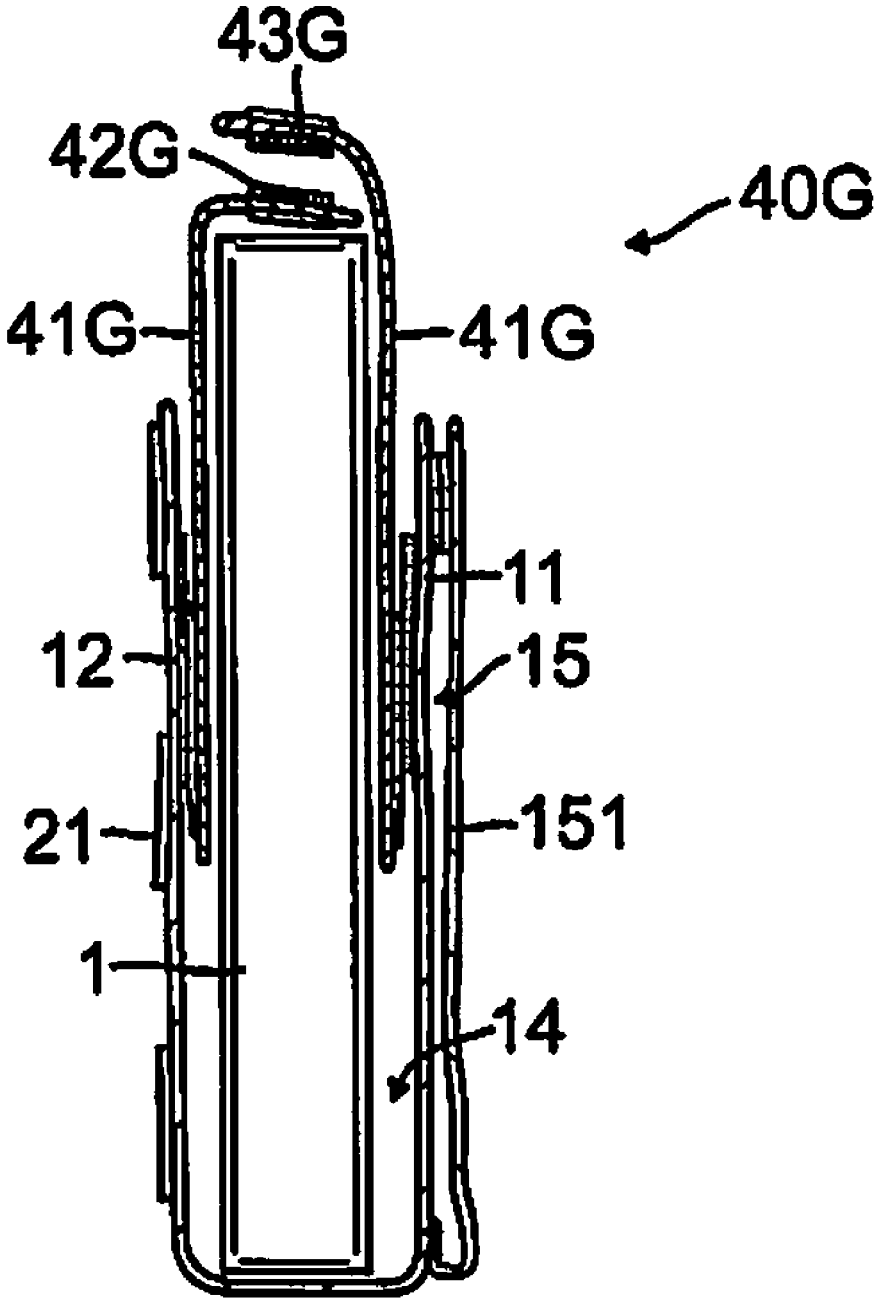

A further modification of the quick accessing fastener 40F is shown in FIG. 3G. The quick accessing fastener 40F comprises an elongated pouch flap 41F overlappedly folded in the respective magazine slot 14 to form a pouch cavity 410F within the magazine slot 14 for holding the magazine 1 therein, wherein two end portions of the pouch flap 41F are extended out of the magazine slot 14 and a portion of the pouch flap 41F is affixed to an upper edge of the magazine slot 14 in such a manner that when one of the corresponding end portions of the pouch flap 41F is pulled outwardly, the pouch flap 41F is slid out from the magazine slot 14 for extracting the magazine 1 in the pouch cavity 410F. Since the portion of the pouch flap 41F is affixed to the outer panel 12 at the upper edge of the magazine slot 14 by sewing, the pouch flap 41F cannot be entirely pulled out from the magazine slot 14 while the magazine 1 can be quickly and easily extracted from the pouch cavity 410F within the magazine slot 14.

As shown in FIG. 3G, the quick accessing fastener 40F further comprises first and second fasteners 42F, 43F respectively provided at the two end portions of the pouch flap 41F wherein the first and second fasteners 42F, 43F are detachably fastened with each other to enclose the pouch cavity 410F for securely holding the magazine 1 therein. Accordingly, the first and second fasteners 42F, 43F are a pair of snap fasteners. In addition, an addition second fastener 44F is formed on the respective end portion of the pouch flap 41F to align with the second fastener 43F such that the first fastener 43F is selectively fastened with one of the second fasteners 43F, 44F to adjust a height of the pouch cavity 410F for fitting the magazine 1 therein.

Figure 4:
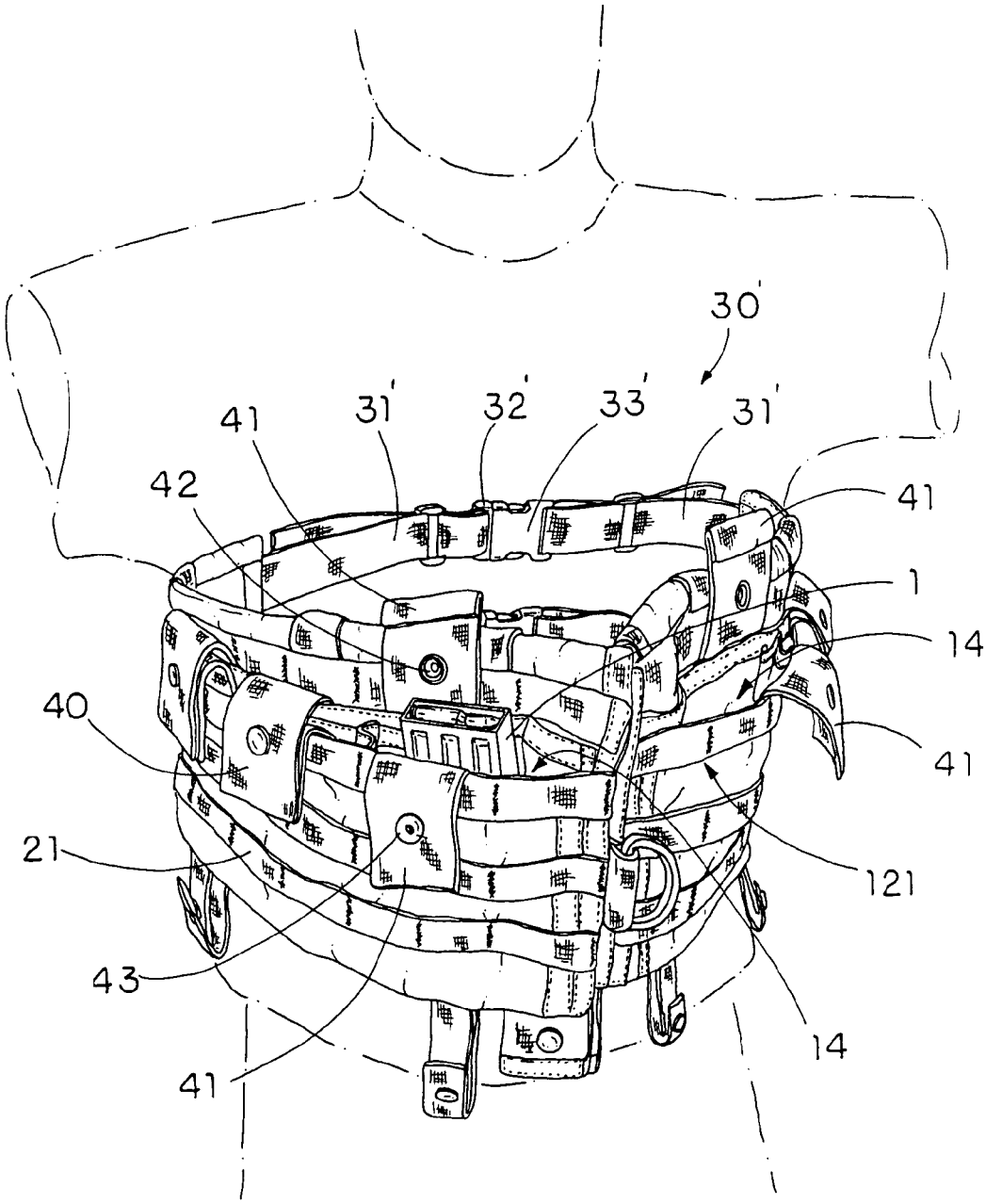
FIG. 4 is a perspective view of the concealed magazine slot arrangement as a chest harness or a midriff harness worn on the user's body according to the above preferred embodiment of the present invention.

FIG. 4 illustrates an alternative mode of the fastening means 30' wherein the concealed magazine slot arrangement serves as a chest harness or a midriff harness. As shown in FIG. 4, the fastening means 30' comprises at least two body straps 31' sidewardly extended from two sides of the magazine holder 10 respectively, and first and second connectors 32', 33' respectively provided at two free ends of the body straps 31' wherein the first and second connectors 32', 33' are detachably connected with each other for fastening the magazine holder 10 on the user's body. Accordingly, the first and second connectors 32', 33' are a buckle plug and a buckle socket such that the magazine holder 10 can be detachably fastened on the chest or midriff of the user.

As shown in FIG. 1, the magazine holder 10 further comprises a map pocket 15 formed on a rear side of the inner panel 11 wherein a pocket panel 151 is overlappedly affixed to the rear side of the inner panel 11 to define the map pocket 15 between the pocket panel 151 and the inner panel 11. It is worth to mention that since the rear side of the magazine holder 10 is wrapped to fit the curvature of the user's body, the map pocket 15 is designed for carrying a map or other sheet like element such as paper instead of carrying a rigid element that the user may feel uncomfortable.

It is obvious that the map pocket 15 can be modified to be a pocket for carrying a bulletproof panel therein for safety purpose.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A concealed magazine slot arrangement for carrying at least a magazine on a user's body, comprising:

a magazine holder comprising an inner panel, an outer panel having a front operation side overlapped on said inner panel, and a plurality of slot dividers transversely and spacedly affixed between said inner and outer panels to form a plurality of magazine slots concealed within said inner panel, said outer panel, and said slot dividers for receiving said magazine;

a gear carrier provided on said front operation side of said magazine holder for carrying a gear thereon;

means for detachably fastening said magazine holder on said user's body, wherein said magazine holder is warped for fitting a curvature of said user's body, such that said outer panel is reinforced to substantially bias against said inner panel to physically self-adjust a shape of said magazine slots for retaining said magazine within said respective magazine slot of said magazine holder; and a quick accessing fastener for securely retaining said magazine within said respective magazine slot and for providing a quick access of said magazine to withdraw from said respective magazine slot, wherein said quick accessing fastener comprises two pouch flaps detachably and adjustably attached to said inner and outer panels respectively within said magazine slot, and first and second fasteners respectively formed at said two pouch flaps, wherein said first fasteners is detachably fastened with said second fastener to enclose said respective magazine slot for securely holding said magazine therein.

2. The concealed magazine slot arrangement, as recited in claim 1, wherein two lower portions of said pouch flaps are detachably attached to said inner and outer panels via two pairs of hook and loop fasteners respectively, wherein said first and second fasteners are provided at two upper portions of said pouch flaps in such a manner that said pouch flaps are selectively attached to said inner and outer panels to adjust a height of said respective magazine slot for fitting said magazine therewithin.

3. The concealed magazine slot arrangement, as recited in claim 1, wherein said fastening means comprises at least two body straps sidewardly extended from two sides of said magazine holder respectively, and first and second connectors respectively provided at two free ends of said body straps, wherein said first and second connectors are detachably connected with each other for fastening said magazine holder on said user's body.

4. The concealed magazine slot arrangement, as recited in claim 1, wherein said fastening means comprises a shoulder strap upwardly extended from said magazine holder and a waist strap sidewardly extended from said magazine holder such that said magazine holder serves as a vest for being worn on said user's body while said magazine slots are positioned at said chest of said user.

5. A concealed magazine slot arrangement for carrying at least a magazine on a user's body, comprising:

a magazine holder comprising an inner panel, an outer panel having a front operation side overlapped on said inner panel, and a plurality of slot dividers transversely and spacedly affixed between said inner and outer panels to form a plurality of magazine slots concealed within said inner panel, said outer panel, and said slot dividers for receiving said magazine;

a gear carrier provided on said front operation side of said magazine holder for carrying a gear thereon, wherein said gear carrier comprises a plurality of webbing straps longitudinally formed on said front operation side of said magazine holder, wherein each of said webbing straps is spacedly sewn on said front operation side of said magazine holder to form a plurality of gear slots for slidably receiving said gear therethrough;

means for detachably fastening said magazine holder on said user's body, wherein said magazine holder is warped for fitting a curvature of said user's body, such that said outer panel is reinforced to substantially bias against said inner panel to physically self-adjust a shape of said magazine slots for retaining said magazine within said respective magazine slot of said magazine holder; and a quick accessing fastener for securely retaining said magazine within said respective magazine slot and for providing a quick access of said magazine to withdraw from said respective magazine slot, wherein said quick accessing fastener comprises two pouch flaps detachably and adjustably attached to said inner and outer panels respectively within said magazine slot, and first and second fasteners respectively formed at said two pouch flaps, wherein said first fasteners is detachably fastened with said second fastener to enclose said respective magazine slot for securely holding said magazine therein.

6. The concealed magazine slot arrangement, as recited in claim 5, wherein two lower portions of said pouch flaps are detachably attached to said inner and outer panels via two pairs of hook and loop fasteners respectively, wherein said first and second fasteners are provided at two upper portions of said pouch flaps in such a manner that said pouch flaps are selectively attached to said inner and outer panels to adjust a height of said respective magazine slot for fitting said magazine therewithin.

7. The concealed magazine slot arrangement, as recited in claim 5, wherein said fastening means comprises at least two body straps sidewardly extended from two sides of said magazine holder respectively, and first and second connectors respectively provided at two free ends of said body straps, wherein said first and second connectors are detachably connected with each other for fastening said magazine holder on said user's body.

8. The concealed magazine slot arrangement, as recited in claim 5, wherein said fastening means comprises a shoulder strap upwardly extended from said magazineholder and a waist strap sidewardly extended from said magazine holder such that said magazine holder serves as a vest for being worn on said user's body while said magazine slots are positioned at said chest of said user.

* * * * *